US005107551A

United States Patent [19]

Weir et al.

[11] Patent Number: 5,107,551

[45] Date of Patent: Apr. 28, 1992

[54] MULTIPLE ACCESSORY SWIMMING POOL COPING

[75] Inventors: Donald H. Weir; Donald E. Dahowski, both of York, Pa.

[73] Assignee: Fox Pool Corporation, York, Pa.

[21] Appl. No.: 623,225

[22] Filed: Dec. 5, 1990

Related U.S. Application Data

[63] Continuation-in-part of Ser. No. 497,965, Mar. 23, 1990, abandoned.

[51] Int. Cl.[5] ..... E04H 4/00; E04H 12/00

[52] U.S. Cl. ..... 4/496; 4/506; 4/498; 52/300

[58] Field of Search ..... 4/496, 497, 498, 503, 4/506, 488, 499, 510; 52/300, 169.7, 222

[56] References Cited

U.S. PATENT DOCUMENTS 4,457,119 7/1954 Dahowski ..... 4/498

4,901,492 2/1990 Coates ..... 4/506

*Primary Examiner*—Henry J. Recla

*Assistant Examiner*—David J. Walczak

*Attorney, Agent, or Firm*—Arthur J. Plantamura

[57] ABSTRACT

A versatile swimming pool coping having at least three horizontal securing channels which open inward to the pool when the coping is positioned at the top of a swimming pool wall for accommodating a plurality of accessories for the swimming pool. The coping is contoured to provide a smooth transition at the corner formed at the juncture of the top of the vertical wall and the horizontal deck around the swimming pool. In a particular embodiment the coping accommodates the bead, of a one-piece vinyl liner which covers the floor and vertical walls, in the bottom channel, a decorative element such as a decorative or light providing strip in a middle channel, and the bead of an accessory which is relatively frequently installed and removed in an upper channel. Also integrally formed as a part of the coping are means to secure the coping at the top of a swimming pool wall. The successive channels above the liner bead holding channel are set back step-wise.

7 Claims, 3 Drawing Sheets

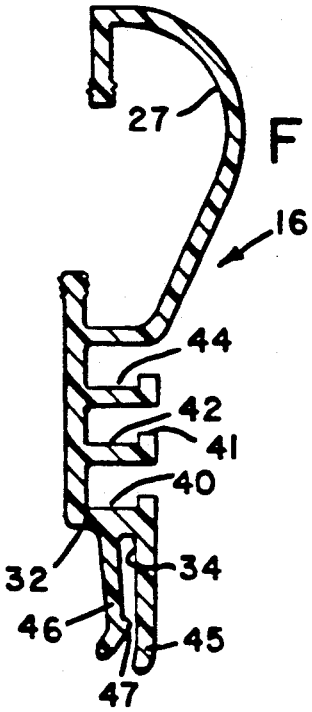
FIG. 3
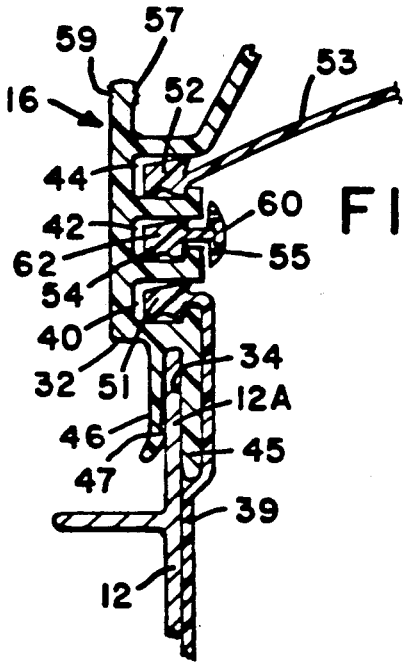
FIG. 4
FIG. 5
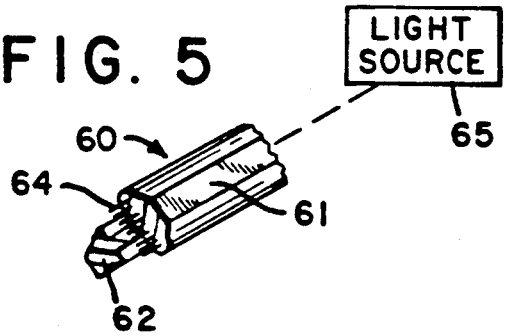
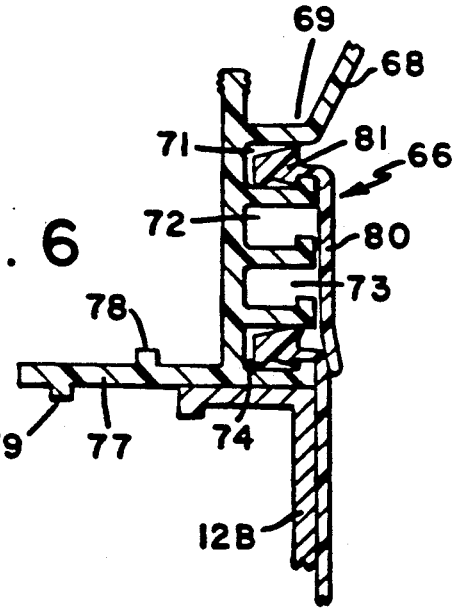
FIG. 6

MULTIPLE ACCESSORY SWIMMING POOL COPING

This is a continuation-in-part of application Ser. No. 07/497,965 filed on Mar. 23, 1990, now abandoned.

This invention relates to a swimming pool coping that affords improved flexibility in that an increased number of accessories for the swimming pool may be conveniently secured, without additional fastening means, in channels that are integrally formed in the coping.

BACKGROUND OF THE INVENTION

In recent years, purchasers of swimming pools, particularly private pool owners, have demanded an increased number of convenience accessories for their swimming pools. Amoung such accessories are covers or domes, decorative strips or fiber optic or other lighting means, sports equipment such as water volley ball net tie down means, and the like. The use of brackets, eye-bolts, and the like, conventional fasteners, as the holding means for an accessory, are unsightly and hazardous because such holding means protrude and can cause injury to the swimmer. A convenient, safe and obscure place to locate such securing means is on the coping element, i.e., below the top cap of the coping and as an integral part of the coping element. In the past, generally it has been sufficient to provide a single channel, or at most two channels as the holding mechanism. Such channels have been formed as a part of the coping element. In the case of a single channel, the channel is devised for use in securing a flexible plastic liner; the liner being suspended from a bead formed at the top of the liner and inserted and held in the channel formed below the top cap of the coping. In structures where a dual channel has been provided, the second channel is usually held available to accomodate a pool cover. Illustrative examples of two-channel prior art coping structures are those disclosed in U.S. Pat. Nos. 3,628,198, 4,429,425 and 4,457,119. In practice, however, with the advent of various other convenience accessories, such second channel is frequently occupied, or is desired for occupation, by another accessory such as a decorative trim or a fiber optics light strip. In the latter case, if the channel is to be available for use by the cover securing bead, such decorative insert or other accessory which is already in place must first be removed. Because of the considerable inconvenience involved in removing an and storing an installed accessory when it is desired to install an additional accessory, such as a pool cover, if the top securing channel is occupied, the provision of additional securing means affords a substantial advantage. Accordingly, a need exists for an arrangement that will conveniently and safely accomodate securing means for additional accessories in the coping structure.

SUMMARY OF THE INVENTION

The invention resides in providing a swimming pool coping comprising at least three accessory retaining longitudinal horizontal channels that are positioned below the coping cap and are integrally formed with the coping: each of the channels being devised to receive and hold in place any of a plurality of accessories.

A particularly advantageous feature of the multiple channel coping structure of the invention resides in the provision of a staggered alignment of the vertically disposed channels. Such staggered structure lends improved stability to the structure when a load is applied to the respective channels and facilitates access to the respective channels when inserting the bead of an accessory in the opening of the channels.

The coping configuration of the invention is adaptable for use in new constructions, or to be substituted, i.e., retrofitted on existing pools when the coping includes at least three horizontal channels and means for securing the coping to the top of the pool wall. Such coping member securing means, optionally but preferably, comprises a vertical downward facing installation groove which receives therein the top of the vertical wall of a prefabricated in-ground swimming pool as the means to facilitate the attachment and securing of the coping in place on the swimming pool. The coping the the invention includes also at least an upper, a middle and a lower channel. These horizontal accessory, bead receiving channels are formed for increased stability by situating the lowermost channel above the downward facing groove and positioning each of the channels above the lowermost channel successively, in a stepwise fashion, slightly rearwardly from the center of the swimming pool. Because the forces from the weight of the accessories in the channels is downward and forward, the effect of the successively staggered relationship of the channels is to lend greater stability to the installed coping from the load applied in the channels. The greater stability results from the balancing or offsetting effect of the load especially in the upper channel which, as can be seen from the staggered arrangement, is to the left of the vertical (centerline) of the swimming pool wall over which the coping is fitted via the downward facing groove of the coping. Thus disposed, the load of the accessory in the lower channel is predominantly to the right of the center-line of the wall while that in the top channel is predominantly to the left of the centerline of the wall Pools of the kind with which the present invention is associated are formed, conventionally, of a plurality of modular wall panels contiguously joined end-to-end to form the peripheral wall of the pool. The wall panels are usually formed of sheet metal, although they may also be formed of other materials such as plastic or fiberglass-plastic composites, for example. The coping which comprises the contoured corner element that forms the transition between the vertical pool wall and the horizontal deck that surrounds the swimming pool is provided with at least three integrally formed horizontally disposed grooves or channels facing the interior of the pool and disposed immediately below the transitional corner segment of the coping. In use, the lower horizontal groove the the coping structure of the invention receives the peripheral bead of a flexible swimming pool liner which is usually formed of vinyl polymer composition. An intermediate groove accomodates therein any of a variety of optional accessories such as a light strip, a decorative trim, sign or symbol, and the like. The top groove or channel is preferably reserved for an accessory which may be frequently attached and detached, such as a swimming pool cover, which by means of suitable formed configuration on the peripheral bead of the cover is securely locked within this coping channel. No additional fastening means such as screws, bolts, clamps, etc. are required to secure the cover within the coping. As is conventional, The side of the coping facing the outside of the pool, contiguous to the top of the coping is open to allow concrete, which also forms the deck around the pool, to flow into the cavity at the top of the coping thereby more securely retaining the coping in position.

When an existing pool is to be equipped with the multiple securing channel coping structure of the invention, the pre-existing coping is replaced with the coping of the invention and is secured at the top of the pool side wall.

BRIEF DESCRIPTION OF THE DRAWING

The invention will be more fully understood from the following detailed description in conjunction with the several illustrative figures of the accompanying drawing in which:

FIG. 3 is a cross sectional view of the coping of the invention illustrating the downward opening vertical groove which receives the top of the swimming pool wall panel and three horizontal accessory accomodating channels.

FIG. 4 is a fragmentary cross sectional view illustrating each of the horizontally facing channels of the multi-channel coping of the invention, the channels being occupied with: the retaining bead of the swimming pool liner in the bottom horizontal channel; a decorative stripor fiber optic light strip in the middle channel; and a retaining bead of a swimming pool cover in the upper channel.

FIG. 5 illustrates a fiber optic light element of the kind which may be secured in a horizontal channel formed in the coping.

FIG. 6 illustrates an alternative coping provided with four horizontal accessory holding channels and an alternative arrangement of securing the coping at the top of the swimming pool wall.

DETAILED DESCRIPTION OF THE INVENTION

Figure 1:
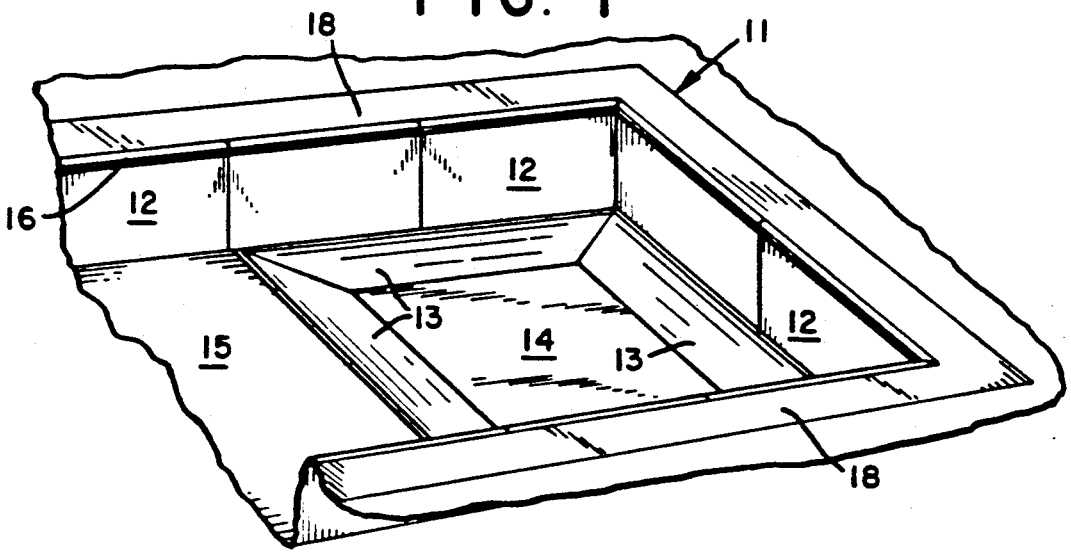
FIG. 1 is a fragmentary perspective view of a conventional swimming pool showing the coping of the invention in place.

The improved coping of the invention is illustrated in position on the swimming pool shown in FIG. 1 of the drawing. As shown in FIG. 1, a fragment of a conventional swimming pool 11 comprising a plurality of wall panels 12 is depicted. The panels 12 are joined and braced in position in an excavation in the ground 10 and form the vertical peripheral wall of the swimming pool 11. The excavation may be designed to provide a deeper portion 14 (which may be used for diving) surrounded by sloping portions 13 and a more gradual slope bottom portion 15 which leads to the shallow end (not shown) of the swimming pool. An advantageously convenient arrangement in swimming pools is to attach the coping 16 at the top of the wall panel 14, as shown in greater detail in FIG. 4, and to secure the coping thereon by pouring concrete into the cavity 27 formed in the upper portion of the coping at the time the horizontal deck 18, surrounding (a part or the entirety of) the swimming pool 11, is formed.

Figure 2:
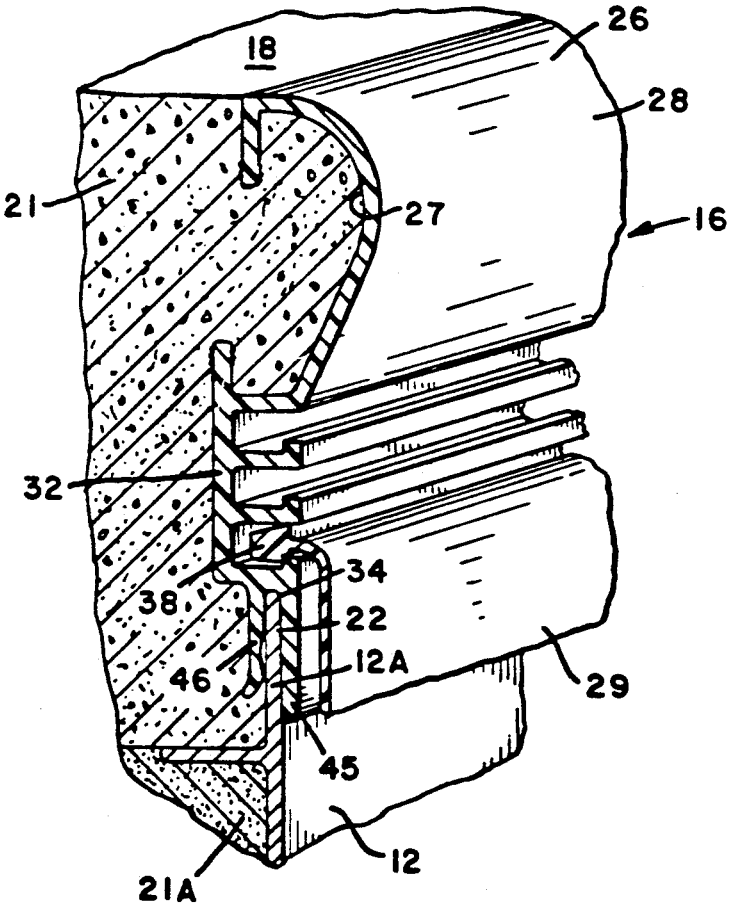
FIG. 2 is a fragmentary perspective view, partly in cross section, of an exemplary installation of the coping of the invention on the swimming pool wall secured with poured concrete and showing the bead of the pool liner in the lower channel and the two upper channels unoccupied and available to accept other accessories.

As shown in FIG. 2, the coping member 16 is mounted at the top 22 of a typical swimming pool wall panel 12. An upper portion 26 of the coping member 16 comprises a convex shaped outer surface 28 (the cap of the coping) comprises the smooth protective transition between the vertical wall 12 and the surrounding horizontal deck 18 of the swimming pool. The rounded top 26 of the coping faces the interior of the swimming pool and blends into the deck 18 which, as noted above usually comprises poured concrete which also fills the concave inner part 27 at the top of the coping 16.

A lower portion 32 of the coping 16 includes as an integral part an open-ended vertical downward facing slot 34 formed by depending legs 45 and 46 (as best seen in FIG. 3) for receiving the top end 12A of the vertical swimming pool wall 12 (see FIG. 4). Between the coping cap 26 and the securing slot 34 are three open-ended horizontal channels, a lower channel 40, a middle channel 42 and an upper channel 44. Each of the channels 40, 42 and 44 preferably include a raised lip 41, at the mouth of the opening to aid in retention in the channel of the accessory holding bead positioned therein.

The arrangement is better illustrated in FIG. 4 wherein each of the horizontal channels 40, 42 and 44 is shown occupied. In FIG. 4, channel 40 is shown as containing the bead 51 of a flexible vinyl plastic liner 39 which normally comprises a preshaped one-piece enclosure tailored to the particular swimming pool and which drapes the swimming pool side walls and covers the pool floor. The middle channel 42 is illustrated as occupied by the bead 54 of a decorator strip 55. This strip bay be rigid or flexible and may contain written information (not shown) on the surface which faces into and is conveniently readable by an occupant of the swimming pool. Such written information may indicate the depth of the water at that point or provide other hazard warning. Alternatively, or in addition thereto, the insert may comprise a fiber optic light strip 60 which aids in illuminating the swimming pool and permit its safe use in the dark.

The top or upper channel 44 may be held open and available for additional accessories, such as the kind, of accessory whose installation and removal may occur at relatively frequent intervals. As such, for example, is a cover or dome to enclose the water in the pool and prevent debris from falling into the pool when it is not in use or for the purpose of retaining heat in the pool water such as during evening hours or at other times when the ambient temperature would tend to substantially chill the water.

The pool deck 18 preferably formed of concrete of suitable thickness and is supported by a brace arrangement (e.g., the support system described in U.S. Pat. No. 3,371,455) and by back fill (not shown). The inner end of the concrete deck 18 is confined by the inner concave surace 27 of the upper portion 26 of the coping 16. The coping 16 is appropriately formed at the lower part with means to suitably secure the coping on the swimming pool. As shown in the embodiment of FIGS. 2–4, the securing mens comprises a pair of bifurcated depending legs 44 and 45 which straddle the top of the wall 12A of the vertical pool wall 12 with leg 46 positioned on the outside and leg 45 positioned on the inside of the wall 12. A grip enhancing configuration may be formed in the groove 34 comprising a restricted portion or protrusion 47 on one of the depending legs, to more firmly retain the coping at the top 12A of the wall 12 until such time as the concrete is poured or the coping is otherwise locked in place. The location of the bifurcated legs 46 and 45 is preferably to the right of the vertical center line of the coping as viewed in FIGS. 2–4, i.e., closer to the interior of the swimming pool, so as to avoid any substantial "cantilever" or overhang of the openings of the horizontal channels 40, 42 and 44 in the interior of the swimming pool. This feature is also described in U.S. Pat. No. 4,457,119.

As shown with reference to FIG. 4, the downward facing groove 34 is located so that, at least the mouth of the bottom lower horizontal channel 40 which accomodates the flexible vinyl liner 39 is positioned so that the liner drapes downward essentially vertically and contiguous to the inner face of the wall 12 avoiding any significant bulge or wrinkling of the liner at the point where the leg 45 of the coping 16 merges with the wall 12 as the liner 39 is pressed against the inner face of the wall 12 by pressure of water in the swimming pool.

The positioning of the lowermost channel, which carries the bead of the vinyl liner, relative to the vertical alignment of the swimming pool wall lessens the cantilever effect due the weight of the liner. However, when a substantial load is applied to the coping via the upper channels, the tendancy to cantilever arises from forces that are forward and downward. The extent of these forces depends upon the amount of weight applied by the accessory, such as a pool cover for example, whose bead is secured in the upper channel. We have discovered that by staggering the upper channels successively step-wise back from the lowermost channel, a substantially more stable coping installation results. Also, because the use of the channels is usually from above, an additional advantage of the step-wise disposition of the successive channels resides in the easier access to the channel openings by the user, relative to a structure in which the respective multiple channel openings are in a vertical alignment configuration.

The cross sectional configuration of the coping of the invention is such that it conveniently lends itself to fabrication as an integral piece such as by extrusion or molding from a suitable rigid or semi-rigid composition which may include a metal, such as aluminum. Preferably the coping comprises a suitable plastic material, either thermoplastic or thermosetting, such as a high impact rigid polyvinyl chloride, or a polyolefin, e.g., polyethylene or polypropylene, nylon, polycarbonate, a glass reinforced plastic, such as nylon or polyester, and the like. The coping may be produced in such length or lengths that facilitate its use at the construction site. In selecting the composition of construction, the flexibility of the coping to bend to fit the contour of the selected pool shape is to be considered.

Illustrated in FIG. 5 is a typical fiber optics light strip such as the kind which is disclosed in U.S. Pat. No. 4,763,984 and which is suitable equipped with means to secure the strip in the coping channel. Such means may comprise a bead 62 which may be integrally formed with and is shown extending from the rear of the fiber optics housing 61. The light transmitting fiber elements are shown at 64. It will be apparent that other known fiber optic or other known lighting means may be adapted for securing in the coping channels. The element 60 of FIG. 5 may be formed so as to have any desired surface contour and design configuration, having aesthetic appearance in mind, and may contain printed information (not shown) on the surface. A power source used to generate light in the strip 60 is shown schematically at 65.

In the alternative coping configuration shown in FIG. 6, the coping 66 comprises an upper coping portion 68, a plurality (four being shown) of horizontally disposed accessory retaining channels 71, 72, 73 and 74 which are designed to have openings that face toward the interior of the swimming pool when the coping is installed, and an anchoring segment 77 to secure the coping on the wall 12B. The securing part 77 of the coping may be provided with one or more protrusions, one upper and one lower, 78 and 79, respectively, being shown, to enhance the gripping, i.e., secure the coping on top of the wall 12B and to hold the coping when this protion of the coping is embedded in concrete which forms the deck surrounding the swimming pool and which fills the outwardly facing cavity 81 at the top 80 of the coping 70. Shown in the top channel 71 of the coping of FIG. 6 is a decorative strip 80 secured in the coping by a means of a bead 81 from which the strip 80 depends. The strip 80 may be of a length to conveniently function as a shroud to aesthetically conceal channels 72 and 73 when these are unoccupied.

Figure 7:
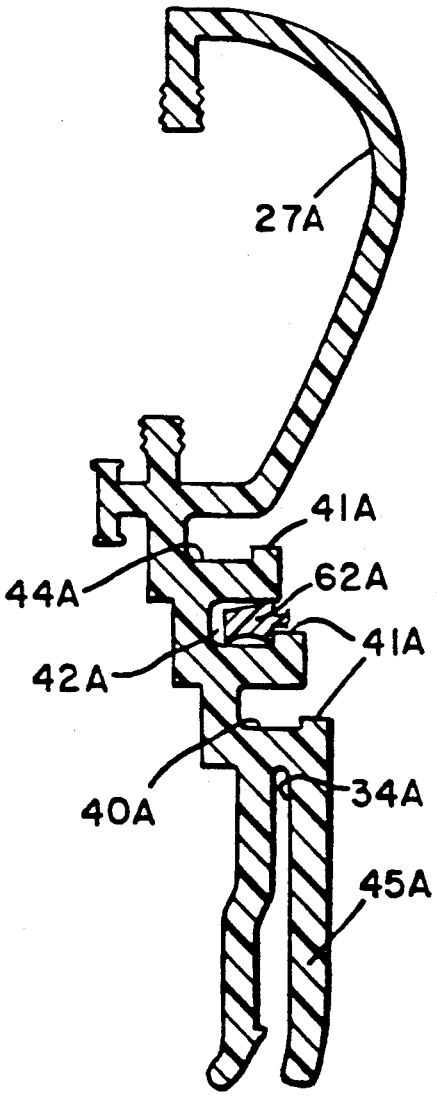
FIG. 7 illustrates in cross section a more preferred configuration of the multiple channel coping in which the respective channels are arranged so that each of the upper channels, above the lowermost channel, is staggered step-wise backward from the interior of the swimming pool relative to the lowermost channel.

In the staggered step-wise embodiment illustrated by FIG. 7, the lowermost channel 40A which is integrally formed with the coping 27A is devised so that it is positioned over the downward facing groove 34A which is fitted over the top of the vertical swimming pool wall (referred to as 12A in FIG. 2) with the depending leg 45A on the inside of the swimming pool wall and the depending leg 46A on the outside of the swimming pool wall. When so disposed, the force of the weight of the accessory whose bead is inserted in the channel 40A is substantially downward and to some extent forward and is absorbed through the vertical swimming pool wall. Forces in the channel above the lowermost channel are also largely downward but tend to have a greater forward component. To offset the forward component, the second channel 42A is formed and positioned so that it is set back step-wise from the lowermost channel 40A. Similarly, the next channel up, 44A, is formed step-wise back from its next lower channel, 42A. The upward projections 41A at the mouth of the respective channel openings function to enhance retention against accidental dislodgement of the bead positioned in the channel.

Figure 8:
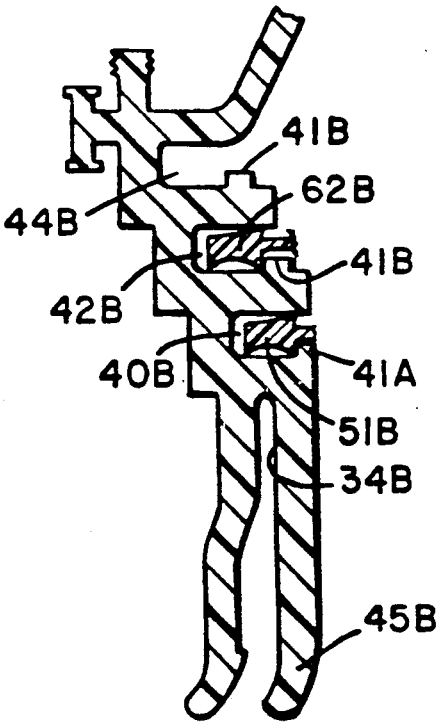
FIG. 8 illustrates a modified embodiment in which an upwardly extending lip, that aids in holding in place a bead inserted in the channel, is moved back from the mouth of the channel to better confine the bead.

In the modified embodiment in FIG. 8, the coping is likewise positioned so that the top of a swimming pool wall is inserted in the downward facing groove 34B with leg 45B on the inside of the wall and the leg 46B on the outside of the wall. Referring to FIG. 8, while the channels 42B and 44B are successively set back step-wise and thereby tend to expand the space in the channels and affect the retention of the bead in respective channels, the bead occupying position in the channel may be controlled by the location of the upward projections 41B contiguous to the channel mouth. The upward projection may be located at the mouth of the channel or moved rearwardly from the mouth of the channel. Thus, with reference to the lowermost channel 40B, the lip 41A is positioned at the opening and functions effectively to retain a bead 51B inserted therein. With respect to channel 42B which is set back step-wise from the channel 40B below, in order to help to better confine and more securely retain the bead 62B in the channel 42B, the lip 41B is preferably set back to reduce the bead confining space. Thus, while the lip 41B, contiguous to the opening of the channel 42B, may be located at the mouth of the channel, because the channel space from the back of the channel to the mouth (because of the setback) is larger than that of the corresponding space in the channel below, the projection 41B for channel 42B is also set back. By so doing, the bead 42B would otherwise be insufficiently confined and therefore more likely to be dislodged if the lip 41B is positioned at the (end) mouth of the opening 42B, is more securely held. It is to be noted that the mouth of the opening of channel 42B is vertically aligned with the mouth of the channel below although the rear wall of channel 42B is set back step-wise from that of channel 40B. With reference to the relationship of channels 44B and 42B, however, both the mouth and back wall of the channel 44B is set back from the mouth and back wall of 42B, i.e., the channel below. Thus, the step-wise backward configuration of the successive horizontal channels affords substantial flexibility to the desired dimension of the channel space occupied by the accessory bead, by locating the projections 41B at the appropriate distance back from the mouth to best accomodate the size of the bead of the accessory that is to be mounted on the coping.

While the preferred embodiments of the invention have been described in detail, it will be understood that the invention includes various alternative details or equivalents encompassed by the claims and adapted by one skilled in the art.

What is claimed is:

1. A coping for a swimming pool used in combination with a flexible swimming pool liner which is secured in and draped from the coping into the interior of a swimming pool and wherein the liner has an upper peripheral securing bead that is fastened on the coping comprising:

(a) an upper coping segment which on one side forms a transitional corner between a vertical wall and a horizontal deck contiguous to the wall and on the other side comprises a concave recess opening outward and adapted to receive concrete poured therein;

(b) a mid segment comprising at least three integrally formed superimposed horizontal channels each having an open front facing interiorily of a swimming pool when the coping is secured on a wall of a swimming pool and a depth extending away from the swimming pool and including (i) a first lower opened channel devised to hold a peripheral bead of a flexible swimming pool liner;

(ii) a second opened channel above the lower channel and having its open front located step-wise rearwardly of the open front of the lower channel and its depth extending step-wise rearwardly of the depth of the lower channel; and (iii) a third opened channel above the second channel and having its open front located step-wise rearwardly from the open front of the second channel and its depth extending step-wise rearwardly of the depth of the second channel, each of the channels (ii) and (iii) providing means for holding an accessory therein; and (c) an integrally formed lower coping segment comprising means for attaching the coping at the top of a vertical wall of a swimming pool.

2. The coping of claim 1 wherein an upward projection is formed contiguous to the mouth of the open channel to aid in retaining an accessory bead inserted in said channels.

3. The coping of claim 2 wherein the upward projection associated with at least one of said channels is set back from the mouth of the open channel.

4. The coping of claim 1 wherein the integrally formed lower segment (c) includes an integrally formed bifurcated element depending below the said lower channel (i), said element devised to straddle and to be secured at the top of a vertical swimming pool wall.

5. The coping of claim 1 wherein the mid segment comprises three channels and wherein the second channel (ii) is equipped with a lighting strip.

6. The coping of claim 1 wherein the second channel (ii) is equipped to receive a decorative trim element.

7. The coping of claim 1 wherein the channel (iii) is equipped to receive means for securing the peripheral bead of a swimming pool cover.

* * * * *